US007636964B2

(12) United States Patent
Bengtsson

(10) Patent No.: US 7,636,964 B2
(45) Date of Patent: Dec. 29, 2009

(54) BUNK FOR A CAB IN A TRUCK

(75) Inventor: Ulf Bengtsson, Hässleholm (SE)

(73) Assignee: FSB Management AB, Klippan (SE)

( * ) Notice: Subject to any disclaimer, the term of this patent is extended or adjusted under 35 U.S.C. 154(b) by 0 days.

(21) Appl. No.: 12/083,311

(22) PCT Filed: Oct. 11, 2006

(86) PCT No.: PCT/SE2006/001149

§ 371 (c)(1),
(2), (4) Date: Jul. 24, 2008

(87) PCT Pub. No.: WO2007/043947

PCT Pub. Date: Apr. 19, 2007

(65) Prior Publication Data

US 2009/0151070 A1 Jun. 18, 2009

(30) Foreign Application Priority Data

Oct. 14, 2005 (SE) ..... 0502279

(51) Int. Cl.
*A47C 23/26* (2006.01)
*A47C 23/00* (2006.01)

(52) U.S. Cl. ..... 5/286; 5/200.1; 5/203; 5/194; 5/186.1

(58) Field of Classification Search ..... 5/186.1, 5/188, 189, 194–196, 200.1, 201, 203, 238, 5/239, 285, 286, 400, 719
See application file for complete search history.

(56) References Cited

U.S. PATENT DOCUMENTS

| | | | | |
|---|---|---|---|---|
| 984,823 | A * | 2/1911 | Linden | 5/279.1 |
| 1,108,515 | A * | 8/1914 | Laden | 5/238 |
| 2,997,141 | A * | 8/1961 | Wetzler | 52/836 |
| 3,056,974 | A * | 10/1962 | McKay | 5/247 |
| 3,441,961 | A * | 5/1969 | Poerink | 5/246 |
| 3,698,022 | A | 10/1972 | Knight | |
| 3,968,528 | A * | 7/1976 | Poerink | 5/211 |
| 4,430,763 | A | 2/1984 | Whitehead | |
| 6,463,651 | B1 * | 10/2002 | Koeneker et al. | 29/513 |
| 6,735,797 | B1 | 5/2004 | Long et al. | |

FOREIGN PATENT DOCUMENTS

| | | |
|---|---|---|
| GB | 1 460 567 | 1/1977 |
| NL | 36468 | 9/1935 |

* cited by examiner

*Primary Examiner*—Michael Trettel
(74) *Attorney, Agent, or Firm*—Breiner & Briener, LLC

(57) ABSTRACT

A bunk (10) in a cab of a truck comprises a profile and a bottom. The profile is substantially L-shaped and has a base member (12) for supporting the bottom. The base member (12) has tongues (23) with punctured holes (24), which are arranged in parallel along the base member (12) and are spaced apart by equal intervals. The bottom can be a net (11) that is arranged over the tongues (23) before bending them over the base member (12). The bottom can alternatively be a board (40) or be a set of transversal ribs (50) or a set of extruded rubber rods (60) that is arranged over the tongues (23) and are fastened to the base member (12) by fastening means (41, 52, 62) through the holes (24).

16 Claims, 5 Drawing Sheets

BUNK FOR A CAB IN A TRUCK

TECHNICAL FIELD

The present invention relates to a bunk for a cab in a truck or the like, comprising a profile and a bottom supported thereby.

BACKGROUND OF THE INVENTION

A modern cab for a large truck or the like is normally provided with at least one bunk in a cab space behind the driver's seat. The bunk is meant to allow a second driver to sleep or rest, while a first driver is driving the truck, so that stops during a long journey can be kept at a minimum.

The bunks in use today can seldomly be adapted to a specific demand from the driver. However, there is an increasing demand for changing the width or the length of the bunk depending on the size of the driver, and also for choosing a certain bottom of the bunk to satisfy different persons' requirements of comfort.

SUMMARY OF THE INVENTION

An object of the present invention is to eliminate the drawbacks mentioned above, which is achieved by assigning to the device the characteristics according to claim 1.

According to one aspect of the invention, there is provided a bunk for a cab of a truck comprising a profile and a bottom supported thereby. The profile is substantially L-shaped with a base member for supporting the bottom, wherein the base member has tongues, which are arranged in parallel along the base member and are spaced apart by equal intervals. The tongues are provided with punctured holes.

The bottom can be made in different ways. For example the bottom can consist of a net, which can be fastened to the profile by arranging the net over the tongues before bending them about 180° over the base member. In a second embodiment the bottom consists of a board made of wood, plywood or the like that can be fixed to the profile by arranging the board over the tongues and using the punctured holes for fastening the board by fastening means. In a third embodiment the bottom consists of a set of transversal ribs made of wood, metal or plastic that at their ends are fixed to two longitudinal elements, which can be fastened to the profile by arranging the elements over the tongues and using the punctured holes for fastening them by fastening means. In a fourth embodiment the bottom consists of a set of extruded rubber threads or rods having fastening elements made of plastic or metal at their ends, which fastening elements can be fastened to the profile by positioning them over the tongues and using the punctured holes for fastening them by fastening means. Plastic support elements are arranged on the rubber rods for distributing the pressure when the bunk is in use.

The profile is made of steel and comprises several partial profiles joined together by corner elements made of plastic or metal. One partial profile comprises a first portion and a second portion, which are riveted, welded or the like together. The first portion consists of the base member and a side member, which are made in one piece and are arranged perpendicularly to each other forming an L-shape. The second portion is made in one piece and consists of four elements, wherein a first element is arranged perpendicularly to a second element and is parallel to a fourth element, and a third element is arranged perpendicularly to the second element and to the fourth element. The fourth element abuts and is riveted, welded or the like to the side member and the first element abuts the base member, when joining together the first and second portions.

Other objects, features and advantages of the present invention will appear from the following detailed description, from the attached drawings as well as from the dependent claims.

BRIEF DESCRIPTION OF THE DRAWINGS

In order to explain the invention, a number of embodiments of the invention will be described below with reference to the drawings, in which.

Same reference numerals have been used to indicate the same parts in the figures to increase the readability of the description and for the sake of clarity.

DESCRIPTION OF EMBODIMENTS OF THE INVENTION

A bunk 10 is to be mounted transversely in a cab of a truck behind the driver's seat. In the bunk 10 a second driver can sleep or rest, so that the truck can be driven with as few stops as possible. It is of great importance during long journeys that this second driver really gets the sleep or rest he needs before changing drivers both for his own safety and for the safety of the other driver or other people driving on the road.

Figure 1:
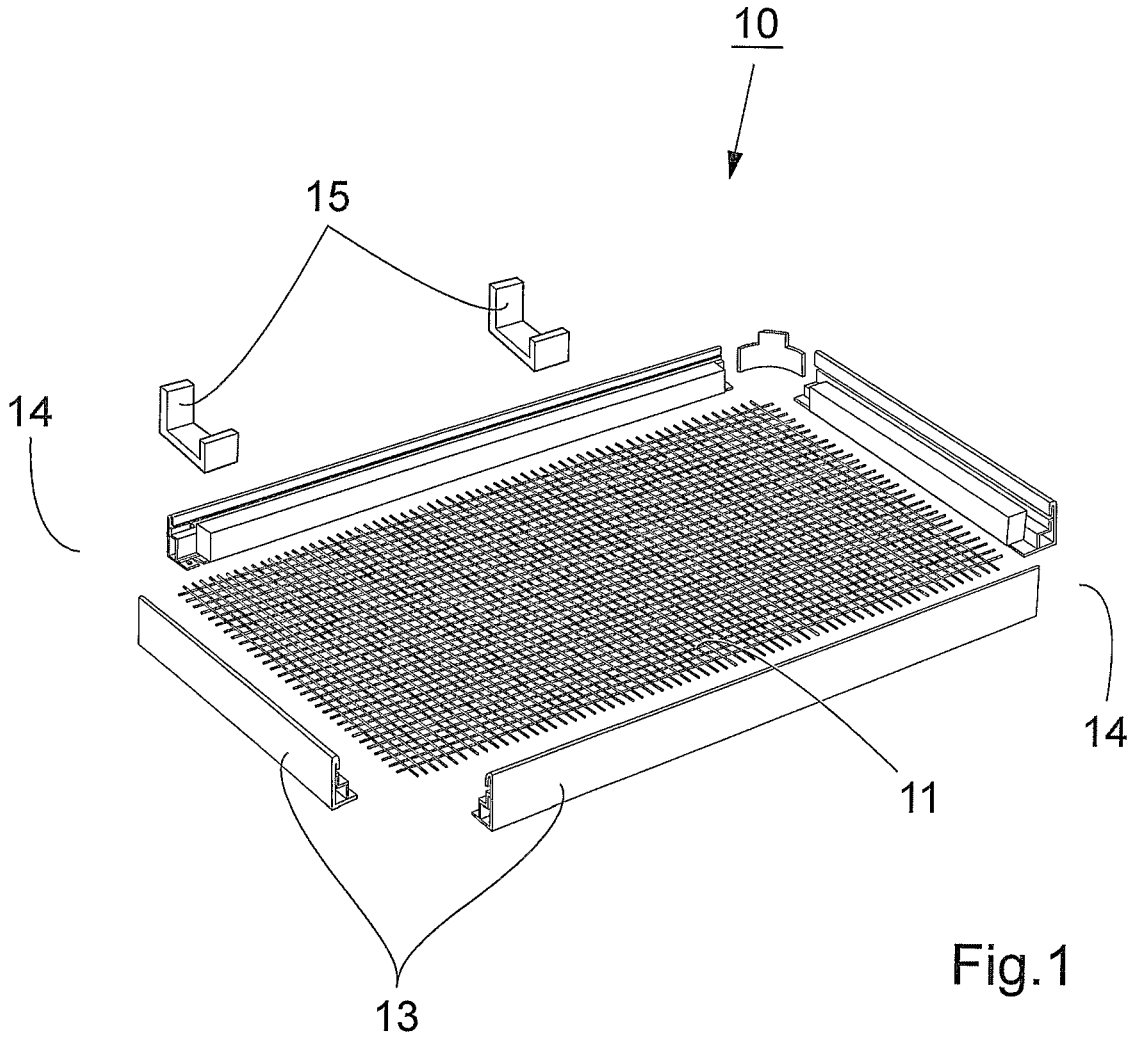
FIG. 1 is a schematic, exploded view in perspective of a bunk in a cab of a truck according to the invention.

The bunk 10 comprises a profile and a bottom, illustrated as a net 11 in FIG. 1. The profile is longitudinal and has a substantially L-shaped cross section with a base member 12 for supporting the bottom. The profile consists of several partial profiles 13, which are joined together by corner elements 14 made of plastic or metal. The profile is made of steel, preferably galvanized steel. The bunk 10 is fastened to a wall in the cab by generally used means 15.

Figure 2:
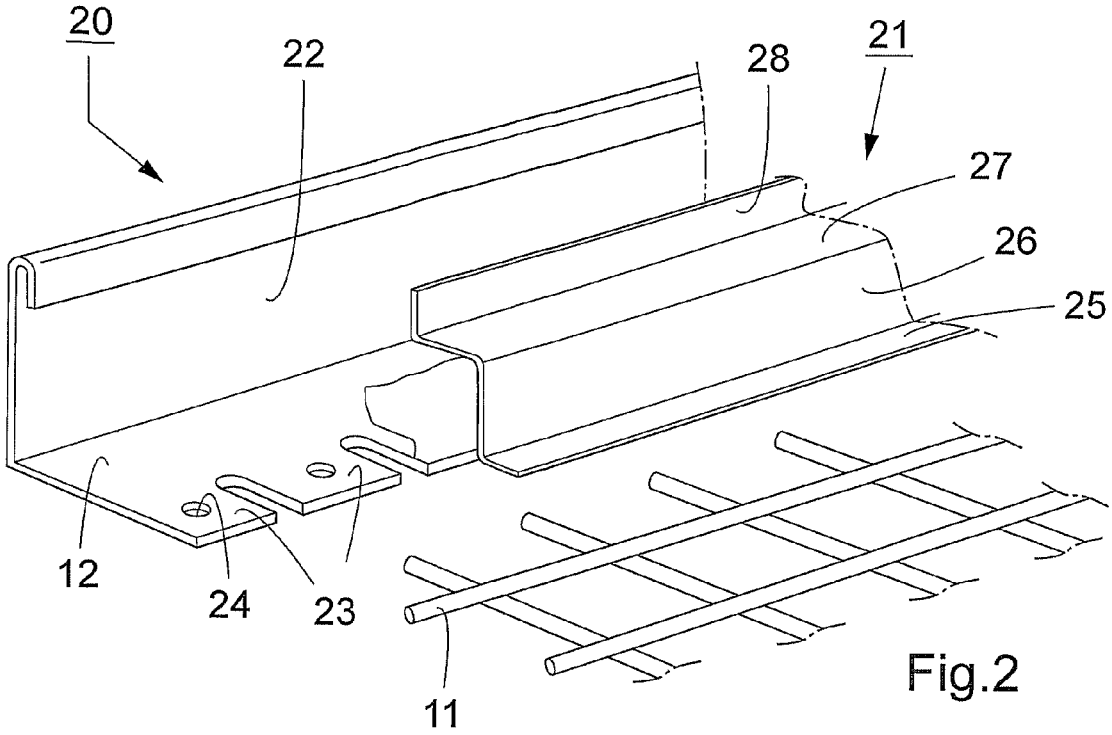
FIG. 2 is a schematic, exploded view in perspective of a partial profile according to the invention.

One partial profile 13 consists of a first portion 20 and a second portion 21, as shown in FIG. 2. The first portion 20 comprises the base member 12 and a side member 22, which are made in one piece and are arranged perpendicularly to each other forming an L-shape. The base member 12 has tongues 23 that are arranged in parallel along a free end of the base member 12 and are spaced apart by equal intervals. The tongues 23 are provided with punctured holes 24 and are bendable 180° over the base member 12.

The free end of the side member 22 can be bent 180° towards the base member 12 forming a fold-over, as shown in FIG. 2.

The second portion 21 is made in one piece and consists of four longitudinal elements. A first element 25 is arranged perpendicularly to a second element 26 and is parallel to a fourth element 28, and a third element 27 is arranged perpendicularly to the second element 26 and to the fourth element 28, as illustrated in FIG. 2.

Figure 3:
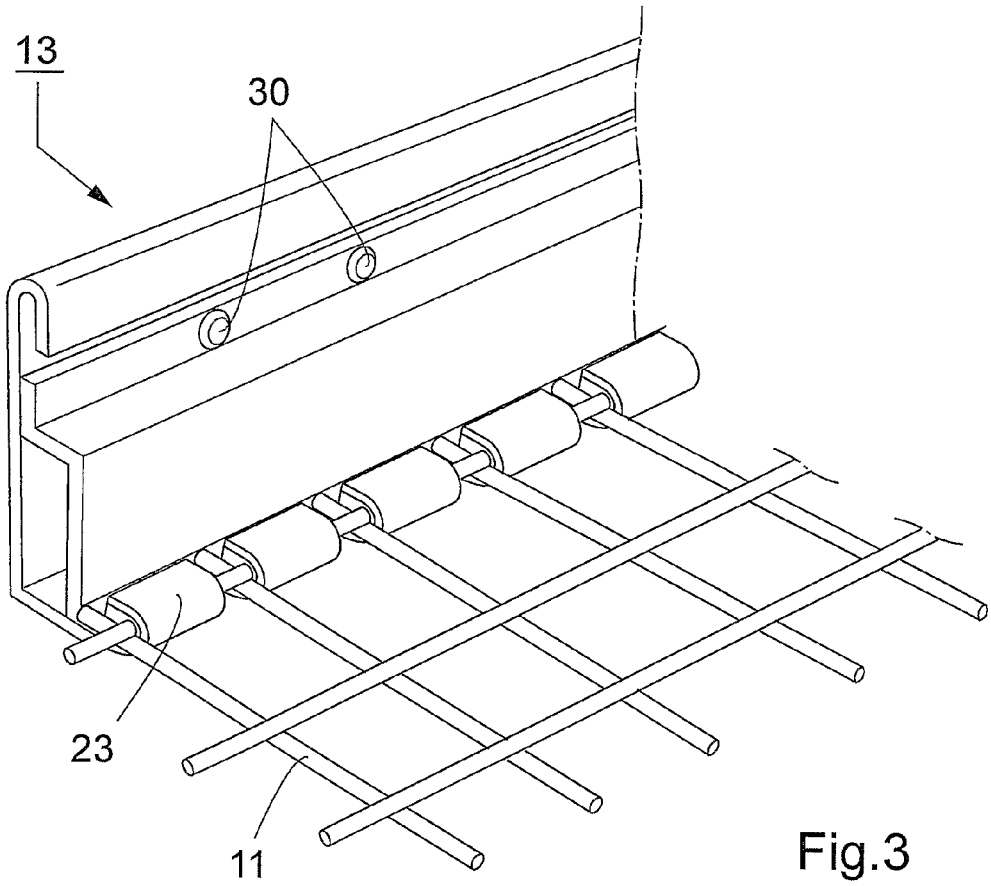
FIG. 3 is a schematic, perspective view of a partial profile having a bottom according to a first embodiment arranged thereto.

The first portion 20 and the second portion 21 are joined together by riveting, welding or the like to form one partial profile 12. Thus, the fourth element 28 abuts and is riveted or welded to the side member 22 and the first element 25 abuts the base member 12, as shown in FIG. 3, rivets 30 being used in this case.

The construction of the profile offers several alternatives regarding type of bottom to be supported thereby. FIG. 3 shows a first embodiment of the bunk 10, wherein the bottom consists of a net that is fastened to the profile by arranging the net 11 over the tongues 23 before bending these about 180° over the base member 12.

Figure 4:
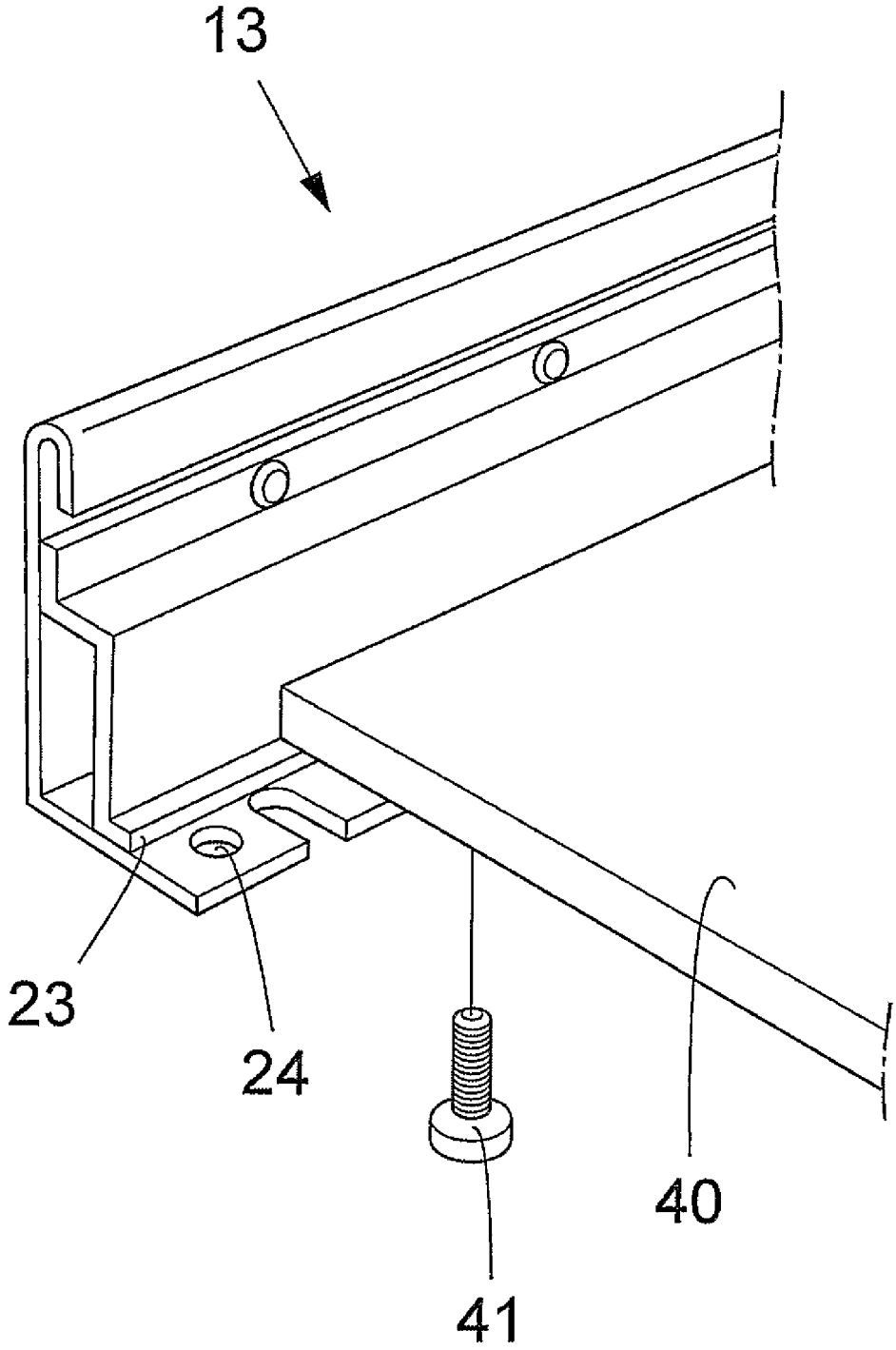
FIG. 4 is a schematic, perspective view of a partial profile having a bottom according to a second embodiment arranged thereto.

A second embodiment of the bunk 10 is shown in FIG. 4, wherein the bottom consists of a board that is positioned over the tongues 23 and the punctured holes 24 are used for fastening the board 40 by fastening means 41. The board is made of plywood, wood or the like. The fastening means are for example screws.

Figure 5:
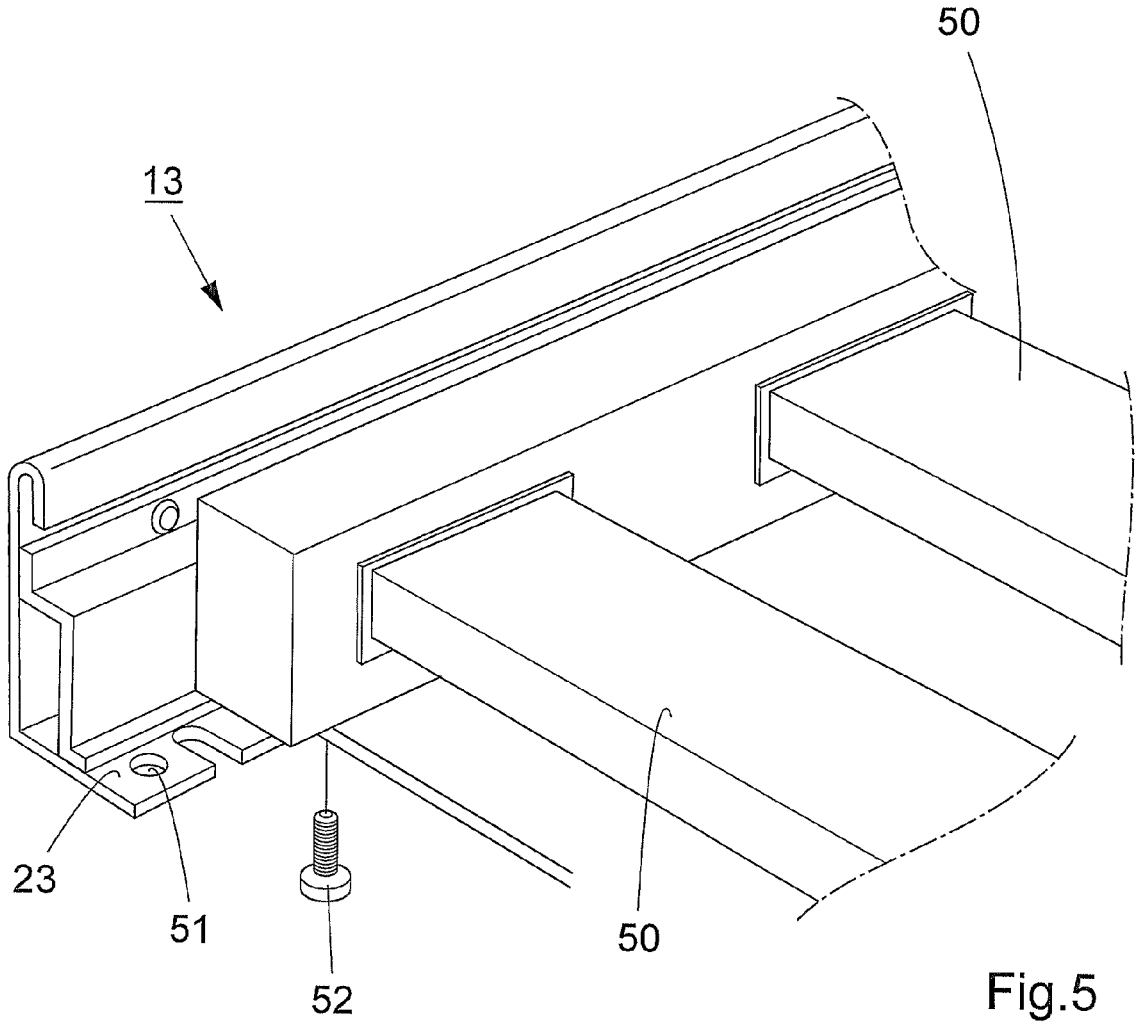
FIG. 5 is a schematic, perspective view of a partial profile having a bottom according to a third embodiment arranged thereto.

FIG. 5 shows a third embodiment of the bunk 10, wherein the bottom consists of a set of transversal ribs 50 that at their opposite ends are fixed to two longitudinal elements 51, respectively, which can be fastened to the profile or the partial profiles 13 by arranging the longitudinal elements 51 over the tongues 23 and using the punctured holes 24 for fastening the elements 51 by fastening means 52, e.g. screws. The ribs 50 are made of wood, metal or plastic.

Figure 6:
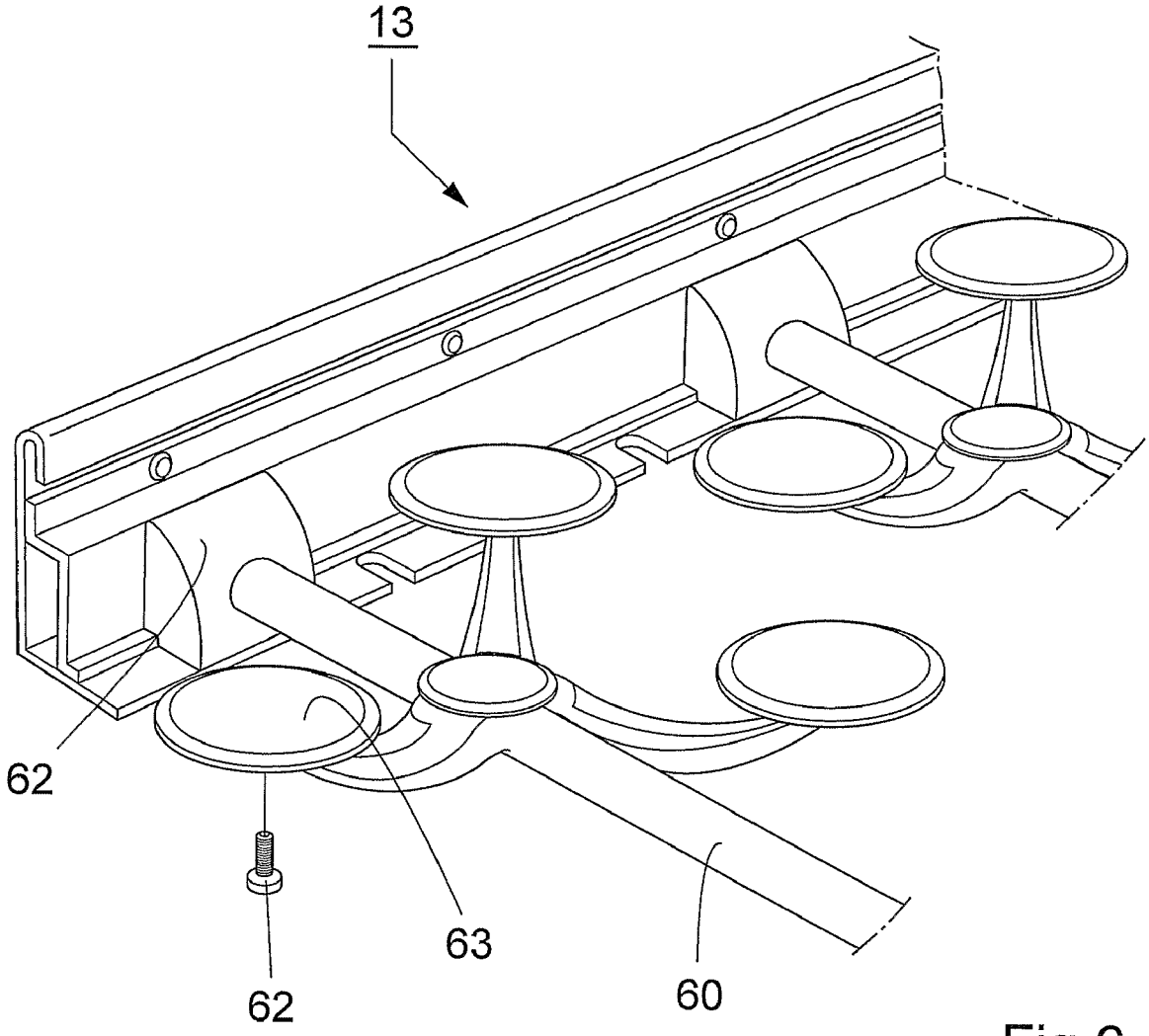
FIG. 6 is a schematic, perspective view of a partial profile having a bottom according to a fourth embodiment arranged thereto.

A fourth embodiment of the bunk 10 is shown in FIG. 6, wherein the bottom consists of a set of extruded rubber threads or rods 60 having fastening elements 61 at their ends. The fastening elements 61 are positioned over the punctured holes 24 of the tongues 23, and are fastened to the base member 12 and to the profile or the partial profiles 13 by using the holes 23 together with fastening means 62, e.g. screws. To make the bunk 10 more comfortable and to distribute the pressure of a person when the bunk 10 is in use, plastic support elements can be arranged on the rubber threads or rods 60. The fastening elements 61 are made of plastic or metal.

Since the profile comprises several partial profiles 13, which are joined together by corner elements 14, it is very easy to modify the length and the width of the bunk 10 to satisfy demands from different persons. To choose between various types of bottoms makes it possible to tailor made the bunk 10 for changeable comfort. Another advantage is that it is easy to adapt the size of the bunk 10 to the space of the truck cab.

In the claims, the term "comprises/comprising" does not exclude the presence of other elements or steps. Furthermore, although individually listed, a plurality of means, elements or method steps may be implemented. Additionally, although individual features may be included in different embodiments, these may possibly be combined in other ways, and the inclusion in different embodiments does not imply that a combination of features is not feasible. In addition, singular references do not exclude a plurality. The terms "a", "an" does not preclude a plurality. Reference signs in the claims are provided merely as a clarifying example and shall not be construed as limiting the scope of the claims in any way.

The invention claimed is:

1. A bunk in a cab of a truck, comprising a profile having a plurality of partial profiles and a bottom supported thereby, wherein each partial profile is substantially L-shaped and comprises a base member for supporting the bottom, wherein the base member has tongues that are arranged in parallel along the base member and are spaced apart by equal intervals, and said each partial profile further comprises a second portion made in one piece having a first element, a second element, a third element and a fourth element, wherein the first element is arranged perpendicularly to the second element and is parallel to the fourth element, and the third element is arranged perpendicularly to the second element and to the fourth element.

2. A bunk according to claim 1, wherein each partial profile of the plurality of partial profiles is joined to an adjacent one of the partial profiles by a corner element made of plastic or metal.

3. A bunk according to claim 1, wherein one partial profile of the plurality of partial profiles comprises a first portion and the second portion, wherein the first portion and the second portion are fastened together.

4. A bunk according to claim 2, wherein one partial profile of the plurality of partial profiles comprises a first portion and the second portion, wherein the first portion and the second portion are fastened together.

5. A bunk according to claim 3, wherein the first portion includes the base member and a side member, which are made in one piece and are arranged perpendicularly to each other forming an L-shape.

6. A bunk according to claim 4, wherein the first portion includes the base member and a side member, which are made in one piece and are arranged perpendicularly to each other forming an L-shape.

7. A bunk according to claim 5, wherein a free end of the side member is bent 180° towards the base member forming a fold-over.

8. A bunk according to claim 6, wherein a free end of the side member is bent 180° towards the base member forming a fold-over.

9. A bunk according to claim 7, wherein the fourth element abuts and is fastened to the side member and the first element abuts the base member, when joining together the first portion and the second portion.

10. A bunk according to claim 1, wherein the tongues are provided with holes.

11. A bunk according to claim 1, wherein the bottom comprises a net which is fastened to the partial profiles by arranging the net over the tongues before bending the tongues about 180° over the base member.

12. A bunk according to claim 1, wherein the bottom comprises a board that is fixed to the partial profiles by arranging the board over the tongues and using the holes for fastening the board by fastening means.

13. A bunk according to claim 1, wherein the bottom comprises a set of transversal ribs made of wood, metal or plastic, the ribs being fixed at ends thereof to two longitudinal elements, which are fastened to the partial profiles by arranging the longitudinal elements over the tongues and using the holes for fastening the ribs by fastening means.

14. A bunk according to claim 1, wherein the bottom comprises a set of extruded rubber threads or rods having fastening elements made of plastic or metal at ends thereof, said fastening elements being fastened to the partial profiles by positioning the fastening elements over the tongues and using the holes for fastening the fastening elements by fastening means.

15. A bunk according to claim 14, wherein plastic support elements are arranged on the rubber rods for distributing pressure when the bunk is in use.

16. A bunk according to claim 1, wherein the partial profiles are made of steel.

* * * * *